US006378320B1

(12) United States Patent
Matambo et al.

(10) Patent No.: US 6,378,320 B1
(45) Date of Patent: Apr. 30, 2002

(54) CONDENSER UNIT FOR AIR CONDITIONER OR HEAT PUMP

(75) Inventors: Thompson J. Matambo; Cosimo Caronna; Danny Ray Burdette, all of Murfreesboro, TN (US); James C. Petty, Huntsville, AL (US)

(73) Assignee: International Comfort Products, Corporation, Lewisburg, TN (US)

( * ) Notice: Subject to any disclaimer, the term of this patent is extended or adjusted under 35 U.S.C. 154(b) by 0 days.

(21) Appl. No.: 09/546,625

(22) Filed: Apr. 10, 2000

Related U.S. Application Data

(60) Provisional application No. 60/163,863, filed on Nov. 5, 1999.

(51) Int. Cl.[7] ..... F25D 23/12; H05K 7/02

(52) U.S. Cl. ..... 62/259.2; 62/259.2; 361/807

(58) Field of Search ..... 165/122; 62/262, 62/450, 455, 428, 508, 259.2; 361/807

(56) References Cited

U.S. PATENT DOCUMENTS 2,891,389 A * 6/1959 Tull ..... 62/262 X
3,792,593 A * 2/1974 Loos et al. ..... 62/262

FOREIGN PATENT DOCUMENTS

JP 0275232 * 11/1990 ..... 62/262

* cited by examiner

*Primary Examiner*—William Wayner
(74) *Attorney, Agent, or Firm*—William W. Habelt

(57) ABSTRACT

A condenser unit (10) for an air conditioner or heat pump system has a cabinet defining a control box (50). A sloping support shelf (52) is provided within the control box (50). Electrical components (72, 74, 76, 80) are mounted to the sloping support shelf (52) so as to facilitate viewability and accessibility.

1 Claim, 3 Drawing Sheets

CONDENSER UNIT FOR AIR CONDITIONER OR HEAT PUMP

CROSS REFERENCE TO RELATED APPLICATION

This application claims priority from provisional application serial number 60/163,863, filed Nov. 5, 1999, entitled "Condenser Unit for Air Conditioner or Heat Pump".

BACKGROUND OF THE INVENTION

The present invention relates generally to central air conditioners, heat pumps and the like, and more particularly, to condenser units for such central air conditioners, heat pumps, and like systems.

Central air conditioning and heat pumps systems of the type used in connection with residential and light commercial typically include a condenser unit located outside and an evaporator unit located inside the space whose temperature is to be controlled. Conventional condenser units include a cabinet housing a fan, an electric motor to drive the fan, a compressor, a heat exchanger and associated piping and valves. Additionally, the cabinet defines a control box housing electrical components, for example a capacitor and electronic controls. A control box cover is removeably attached to the cabinet.

To service the controls and electrical equipment, a service technician removes the control box cover. In some prior art designs, the control box is located in a side panel of the cabinet. In other prior art designs, the control box is located in a comer of the unit. In either design, the electrical components are typically mounted on a vertical surface. As a result, the viewing angle for diagnostics is limited and it is often difficult for the service technician to view information provided on component labels, for example the capacitor without removing the component and its mounting bracket from the wall.

SUMMARY OF THE INVENTION

It is an object of the present invention to provide a condenser unit having a control box wherein the electrical components housed therein are readily viewable and accessible for service.

The condenser unit of the present invention includes a control box having a support shelf having a sloping surface on which electronic components are mounted. The support shelf may also include a vertical surface, depending from the sloping surface, to which a capacitor may be mounted so as to extend generally horizontally beneath the sloping surface of the support shelf.

BRIEF DESCRIPTION OF THE DRAWINGS

Further objects and advantages of the present invention will be apparent from the following description of an exemplary embodiment of the present invention wherein reference is made to the accompanying drawings, wherein.

DETAILED DESCRIPTION OF A PREFERRED EMBODIMENT

Figure 1B:
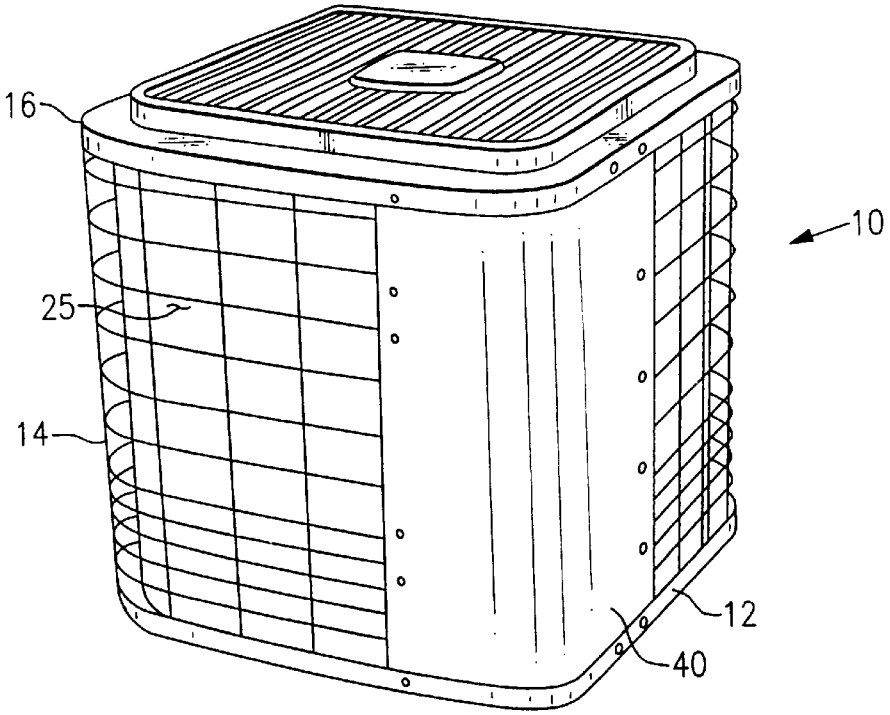
FIG. 1*b* is a side perspective view of a condenser unit for an air conditioner or heat pump.
Figure 1A:
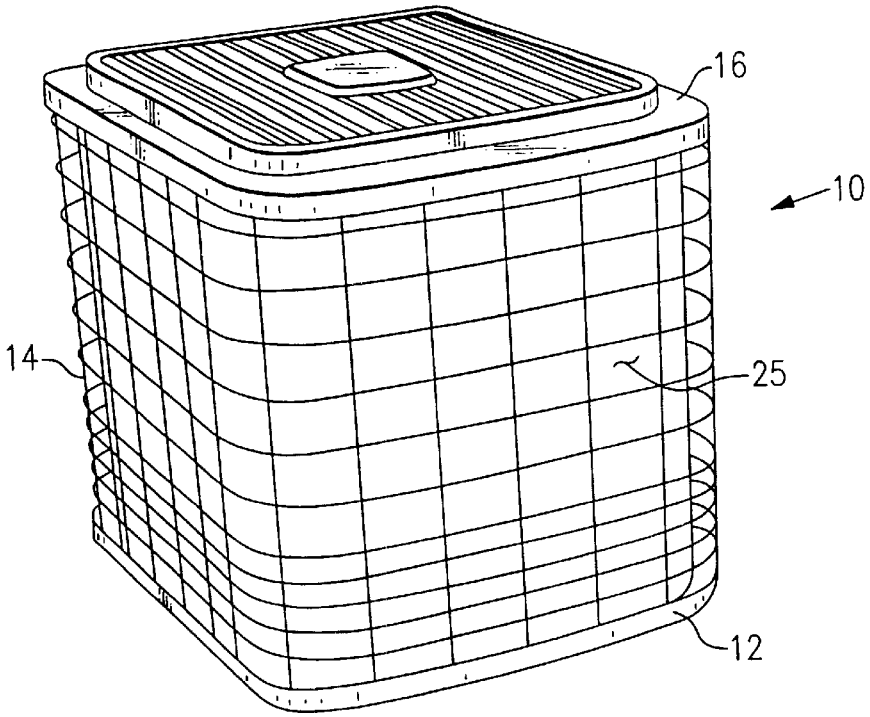
FIG. 1*a* is a frontal perspective view of a condenser unit for an air conditioner or heat pump.

Referring now to the drawings, there is depicted therein a condenser unit, also commonly referred to as a condensing unit, of a central air conditioner or heat pump system. The condenser unit 10 includes a bottom pan 12, an upstanding grill work 14, a top panel 16 and a control box cover panel 40 forming a cabinet assembly. The cabinet assembly houses a compressor (not shown), a heat exchanger 25, a fan and motor assembly (not shown), and associated refrigerant piping and valves (not shown). Typically, the heat exchanger 25 comprises an assembly of finned tubes in a cylindrical or parallelpiped form, although the particular type of heat exchanger used is not germane to the present invention. In operation, air is drawn through the grill work 14 and thence through the heat exchanger 25 by the fan and motor assembly mounted to the bottom side of top panel 16 to cool the refrigerant passing through the tubes of the heat exchanger 25. The air having passed through the heat exchanger 25 discharges through a grill work provided in the top panel 16. A removable control box cover panel 40 is mounted to a control box 50 formed in one comer of the condensing unit 10.

Figure 2:
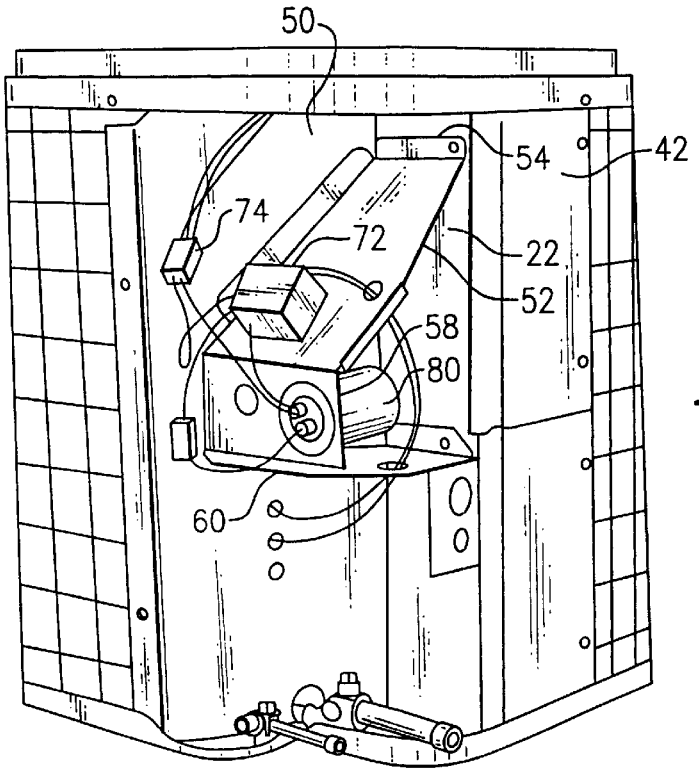
FIG. 2 is a perspective view of the control box of the condenser unit of FIG. 1 with the control box cover panel removed.
Figure 3:
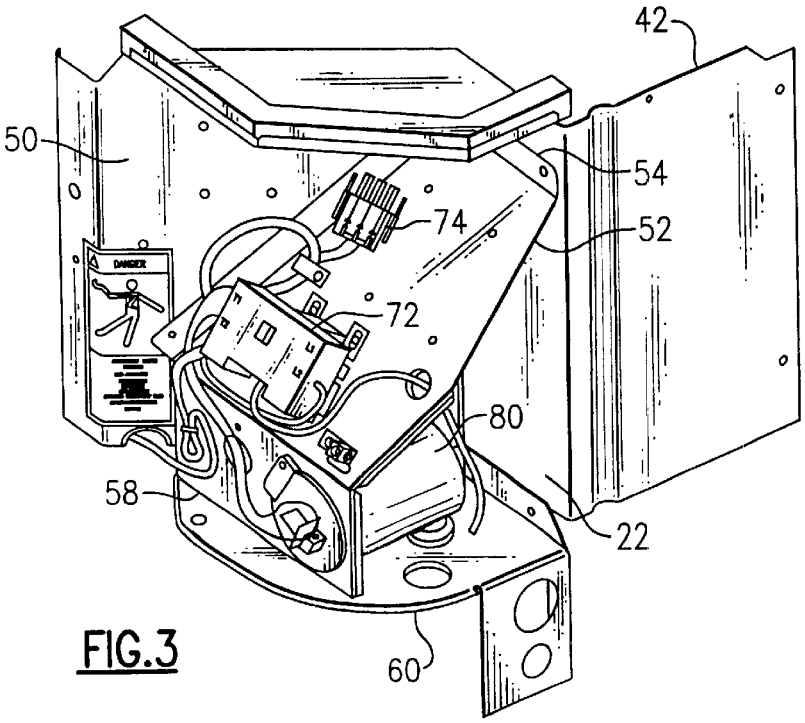
FIG. 3 is an enlarged perspective view of the control box of FIG. 2 showing an alternate arrangement of electrical components mounted therein.
Figure 4:
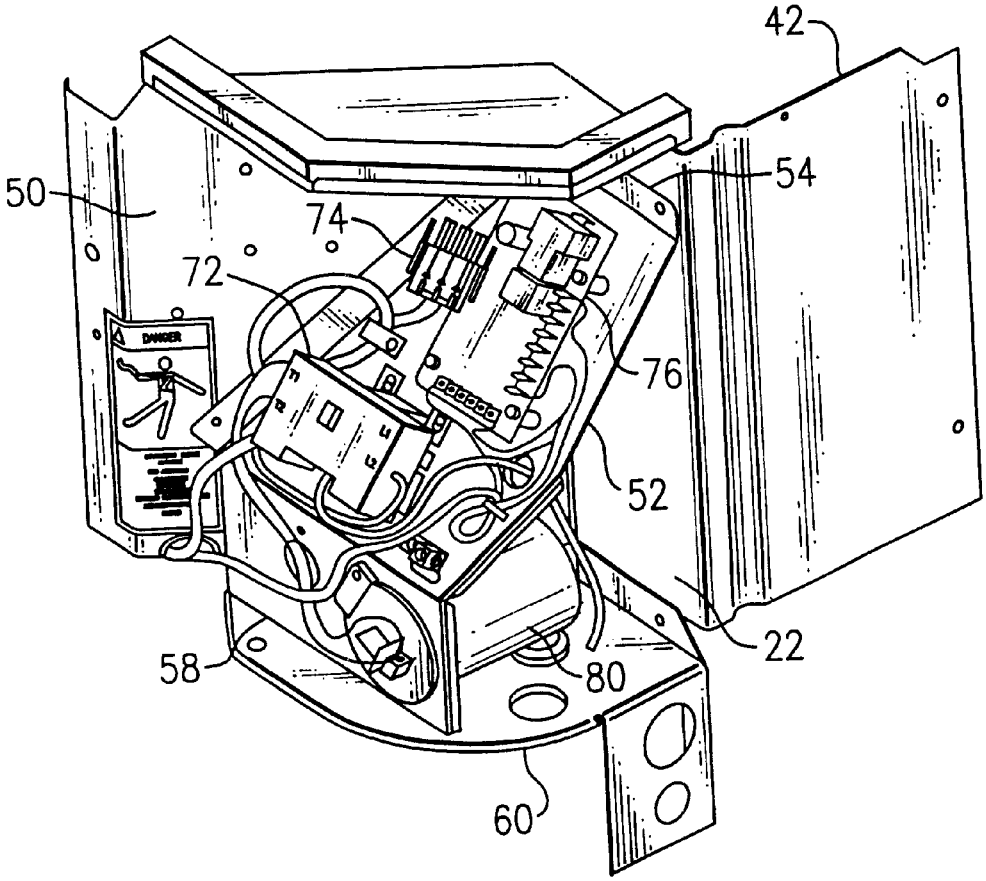
FIG. 4 is an enlarged perspective view of the control box of FIG. 2 showing an alternate arrangement of electrical components mounted therein.

As best seen in FIGS. 2, 3, and 4, the control box 50 includes a support shelf 52 secured by an upper flange 54 to a vertical surface 22 of the control box panel 42. In accordance with the present invention, the support shelf 52 is not horizontally disposed, but rather extends from the vertical surface 22 at an angle downwardly toward the opening to the control box 50. The support shelf 52 is mounted at its lower end to a horizontal base shelf 60, also supported from the control box panel 42, forming the bottom of the control box.

Further in accordance with the invention, electrical components 70 are mounted on the upper surface of the sloping support shelf 52 whereby all the terminals are easily viewable and accessible to the service technician after removal of the cover 40. In the embodiment depicted in FIG. 3, typical of an air conditioner application, a terminal box 72 and plug assembly 74 are mounted on the upper surface of the sloping support shelf 52. In the embodiment depicted in FIG. 4, typical of a heat pump application, an electronic control board 76, such as for example a defrost control board, is also mounted to the upper surface of the sloping support shelf 52.

The lower portion 58 of the support shelf 52 may extend substantially vertically to the base shelf 60. In this manner, the lower portion 58 provides a substantially vertical surface to which the capacitor 80 may be mounted with its terminals facing the control box opening and its body extending substantially horizontally from the reverse surface of the lower portion 58. The body of the capacitor 80 is therefore disposed beneath the support shelf 52 and in clear view of the service technician. Additionally the terminals of the capacitor are easily viewable and accessible to the service technician.

The invention has been described hereinbefore in detail by way of reference to the embodiments depicted in the accompanying. It is to be understood that other modifications, variations and arrangements may be contemplated by those skilled in the art without departing from the spirit and scope of the present invention. For example, alternative top panel designs, grill work designs, heat exchanger designs, electrical and electronic components may be employed that differ from those depicted in the accompanying drawings and described herein.

What is claimed is:

1. A condensing unit for an air conditioner or heat pump comprising a cabinet assembly housing a compressor, a fan and motor assembly and a heat exchanger, and control box associated with the cabinet assembly, characterized by a support shelf disposed within the control box, said support shelf having a sloping portion providing an accessible surface having an electrical component mounted thereon and having a lower portion extending downwardly from said sloping portion and providing a substantially vertical surface having a capacitor mounted thereon so as to extend beneath the sloping surface of said support shelf.

* * * * *